US006626570B2

(12) United States Patent
Fox et al.

(10) Patent No.: US 6,626,570 B2
(45) **Date of Patent: *Sep. 30, 2003**

(54) PRODUCE BAG WITH DRAW TOP

(75) Inventors: L. Keith Fox, McAllen, TX (US); Kenneth S. Fox, McAllen, TX (US)

(73) Assignee: Kenneth Fox Supply Company, McAllen, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/788,909

(22) Filed: Feb. 19, 2001

(65) Prior Publication Data

US 2001/0019638 A1 Sep. 6, 2001

Related U.S. Application Data

(63) Continuation-in-part of application No. 09/694,359, filed on Oct. 23, 2000, now Pat. No. 6,416,220, and a continuation-in-part of application No. 09/349,312, filed on Jul. 8, 1999, now Pat. No. 6,190,044, and a continuation-in-part of application No. 09/174,435, filed on Dec. 16, 1998, now Pat. No. 6,030,120, which is a continuation-in-part of application No. 09/212,169, filed on Oct. 16, 1998, now Pat. No. 6,024,489.

(51) Int. Cl.[7] ..... B65D 33/28

(52) U.S. Cl. ..... 383/9; 383/75; 383/76; 383/117; 383/121

(58) Field of Search ..... 383/75, 76, 9, 383/117, 121, 122

(56) References Cited

U.S. PATENT DOCUMENTS

| | | | | |
|---|---|---|---|---|
| 1,822,948 | A | | 9/1931 | Armstrong |
| 1,906,500 | A | | 5/1933 | Twitchell |
| 2,085,365 | A | | 6/1937 | Israel |
| 2,128,658 | A | | 8/1938 | Millett |
| 2,428,266 | A | | 9/1947 | Daniels |
| 2,646,203 | A | | 7/1953 | Brady |
| 2,734,541 | A | * | 2/1956 | Ottinger ..... 383/121 |
| 2,774,402 | A | | 12/1956 | Wikle |

(List continued on next page.)

FOREIGN PATENT DOCUMENTS

| | | |
|---|---|---|
| EP | 677450 A1 | 10/1995 |
| ES | 1033033 | 7/1996 |
| GB | 837421 | 6/1960 |

OTHER PUBLICATIONS

"FD–35V High–speed, center press–seal, automatic bag making machine" [online], Totani Corp., 1997, [retrieved on Jul. 7, 1999]. Retrieved from the Internet:<URL:www.totani.co.jp/ENGLISH/E_SC/E_FDFA/eFDF35.htm.

*Primary Examiner*—Lee Young
*Assistant Examiner*—Joseph C. Merek
(74) *Attorney, Agent, or Firm*—Bracewell & Patterson LLP

(57) ABSTRACT

A bag has one side wall of a synthetic resin mesh material and the other side wall of a synthetic resin film. Each of the side walls has a draw sleeve or top extending along its upper portion to receive a draw tape, draw string, draw band, draw cord or the like. The synthetic resin film side wall has a side wall portion which extends below the mesh wall, with a lower fold being formed in the film wall to form a bottom of the bag. The synthetic resin film side also has an extension from the lower fold which is folded upwardly to join with and enclose a lower portion of the mesh side wall. The bottom portion of the bag is thus formed of synthetic resin film which yields to the impact of articles entering the bag to fill it. No seam is present between the side walls of the bag in the bottom area of the bag where it would be subject to the impact of entering articles. A reinforcing strip of synthetic resin film may, if desired, be formed along an upper portion of the mesh wall of the bag, and spaced holes for wicket pin attachment then formed in the reinforcing strip.

18 Claims, 5 Drawing Sheets

U.S. PATENT DOCUMENTS 2,853,225 A 9/1958 Bauer
2,952,397 A 9/1960 Doyle
3,013,597 A * 12/1961 Moran ..... 383/6
3,123,279 A 3/1964 Day
3,257,915 A 6/1966 Cartier et al.
3,279,511 A 10/1966 Griffin, Jr.
3,554,368 A 1/1971 Nagel
3,567,111 A * 3/1971 Baxter et al. ..... 383/121
3,653,583 A * 4/1972 Meyer ..... 383/26
3,721,603 A 3/1973 Takeda
3,733,024 A 5/1973 Bolling, Jr.
3,967,544 A 7/1976 Brock et al.
4,002,519 A 1/1977 Moseley et al.
4,036,363 A * 7/1977 Kugler ..... 206/526
4,207,983 A 6/1980 Wolske
4,301,961 A 11/1981 Rodish
4,386,924 A 6/1983 Crawford et al.
4,403,637 A 9/1983 Sabater et al.
4,451,249 A 5/1984 DeBin
4,491,217 A 1/1985 Weder et al.
4,566,927 A 1/1986 Wood
4,832,677 A 5/1989 Hudgens et al.
4,842,421 A * 6/1989 Bullard et al. ..... 383/61.4
4,880,316 A * 11/1989 Belmont et al. ..... 383/75
4,881,933 A 11/1989 Wech
4,883,450 A 11/1989 Benoit
4,889,523 A 12/1989 Sengewald
4,974,968 A 12/1990 Mandus et al.
4,988,213 A 1/1991 Mattle
5,006,380 A * 4/1991 Fraser ..... 383/72
5,265,961 A * 11/1993 Boyd ..... 383/104
5,294,148 A 3/1994 Imai
5,401,101 A 3/1995 Wang
5,417,638 A 5/1995 Anderson et al.
5,571,361 A 11/1996 Stuerzel
5,741,076 A 4/1998 Cammack
5,823,683 A 10/1998 Antonacci et al.
5,830,119 A * 11/1998 Chen ..... 383/117
6,024,489 A * 2/2000 Fox et al. ..... 206/554
6,030,120 A * 2/2000 Fox et al. ..... 206/554
6,190,044 B1 * 2/2001 Fox et al. ..... 206/554

* cited by examiner

PRODUCE BAG WITH DRAW TOP

CROSS-REFERENCE TO RELATED APPLICATIONS

The present application is a continuation-in-part of prior U.S. patent application Ser. No. 09/694,359 filed Oct. 23, 2000, now U.S. Pat. No. 6,416,220, issued Jul. 9, 2002, and of prior U.S. patent application Ser. No. 09/349,312 filed Jul. 8, 1999, now U.S. Pat. No. 6,190,044, issued Feb. 20, 2001; each of which is in turn a continuation-in-part of prior U.S. patent application Ser. No. 09/174,435, filed Oct. 16, 1998, now U.S. Pat. No. 6,030,120, issued Feb. 29, 2000; and Ser. No. 09/212,169, filed Dec. 16, 1998, now U.S. Pat. No. 6,024,489, issued Feb. 15, 2000.

BACKGROUND OF INVENTION

1. Field of Invention

The present invention relates to produce bags with draw tops and having side walls of differing type synthetic resin materials, more specifically one of the side walls being of a synthetic resin film and the other side wall being of a synthetic resin fiber mesh.

2. Description of the Prior Art

Composite bags formed of one synthetic resin mesh sheet and one synthetic resin film sheet have been proposed. So far as is known, however, the two sheets have been joined together along a common inner seam formed between the two walls at a bag bottom on or near the bottom portions of the sheets. The common inner seam was thus located to form the bottom of the contents holding portion of the bag. However, with this structure, problems have arisen, particularly with relatively large or comparatively heavy items such as potatoes or other produce. The weight and impact of these types of items as they were introduced during bag filling were received directly onto the seam joining the bag wall sheets together. Problems with breakage or rupture of the seams have occurred because of this. Further, bag filling operations have been disrupted and products for filling the bags spilled or wasted.

Wicket produce bags have been developed for automatic produce packing machines. One portion of the bag has holes formed in it so that the bags can be suspended from wickets or pegs on an automatic packing machine. The earliest such bags were of polyethylene film. Machines and methods for forming produce bags of a synthetic resin fabric mesh have been recently developed by the assignee of the present application, for example as described in co-pending U.S. patent application Ser. No. 08/888,175, filed Jul. 3, 1997, now U.S. Pat. No. 6,080,093. These bags were formed of a synthetic resin fabric mesh, such as the woven fabric of cross-laminated synthetic resin fibers known as Cross Laminated Airy Fabric or (CLAF®) from Atlanta Nisseki CLAF, Inc. This fabric is an open mesh material of cross-laminated warp and weft strands or fibers of synthetic resin.

These types of bags are particularly useful for produce that must have access to fresh air to preserve the shelf life of the produce. However, when wicket holes are formed in this type of fabric mesh for automatic produce bag filling or packing machine purposes, problems have been found to occur. Slits were formed in the mesh in the area of the wicket holes leading away from the holes. The slits were formed in order to aid in tearing of the bag away from the packing machine once the bag was filled with product.

When the fabric mesh was slit for this purpose near the wicket holes, only a certain number of synthetic resin fiber strands in the fiber mesh were left uncut. The remaining uncut fiber strands were the sole support for the bag when it was suspended from the wicket rods or pegs and being filled with product. The number of strands left uncut was variable and indeterminate, and the reliability of the bags for use in automatic packing machines suffered. Bags with too many strands cut did not have adequate strength for use and would fall from the wickets during filling operations. Faulty bags could slow up operation of automatic packing machines by falling from the wickets when being filled with produce.

Produce bags of certain types have been provided with draw strings or cords in their tops. So far as is known, the prior produce bags with draw strings or cords have been formed from bag material of either woven or knitted mesh. These have been desirable, for end users or purchasers are provided with a built-in closure mechanism permitting the bag to be re-closed after some of its contents were removed. The drawstring or draw cord also provided a lifting or carrying grip.

Another type of produce bag which has been available is a bag formed with both side walls of a synthetic resin film material. So far as is known, these bags are planned to be disposable. For this reason, the cost of producing a drawstring in this type of bag has made use of a drawstring undesirable. Another problem has been that there are, so far as is known, no satisfactory machines for making a bag of this type with a drawstring.

SUMMARY OF INVENTION

Briefly, the present invention provides a new and improved composite synthetic resin bag with a draw top to accommodate a draw member in it. The bag is formed of first and second side walls which are joined together along a bottom portion and two side edges. One of the side walls is formed from a cross-laminated synthetic resin fiber material mesh, such as a CLAF® material or the like, and the other side wall is formed of a synthetic resin film, such as polypropylene or polyethylene or the like. The wall of mesh material preferably forms a back or rear wall of the bag when placed on wicket pins of the equipment for product filling. The film wall preferably serves as the front or forward wall.

A first draw sleeve extends laterally along an upper portion of the first side wall of the bag, and a second draw sleeve extends laterally along an upper portion of the second side wall of the bag. Each of the draw sleeves has a draw member mounted in it. The draw member may be a band, strip, web, cord, string or the like. A slot is formed in each of the first and second draw sleeves for access by a user of the bag to the draw member.

The synthetic resin fiber mesh bag wall extends downwardly a certain predetermined length, but slightly less than the entire length of a completed bag. The film bag wall extends over a front face portion of the entire length of a completed bag and in addition has a further downward extension. When the bag is assembled, the downward extension is folded upwardly against an outer surface of the fiber mesh rear bag wall. The fiber mesh bag wall and the upwardly folded film wall extension are joined together at a seam spaced upwardly from the folded synthetic resin film bottom portion. The bag when assembled thus has a bottom portion which is formed entirely of a folded portion of synthetic resin film. The resin film has been found to be more elastic and thus resistant to impact and weight of produce as they enter the bag during packing.

It has been found that the fold of synthetic resin film exhibits greater strength during bag packing. Further, the seam between the fiber mesh wall and the film wall is spaced upwardly from the bottom of the bag and thus not directly subject to impact and weight of the product as it enters the bag during packing. An improved top corner seal structure is provided where the reinforcing strip and the front and rear side walls are joined. Bags according to the present invention exhibit greater strength in use during packing operations and are thus more reliable. Waste and damage to produce as a result of bags splitting at their bottom seams, either during loading or subsequent handling, are reduced with bags according to the present invention.

Bags according to the present invention are also adapted for use in bag-filling machines with wicket pins. In these cases, the fiber mesh side wall of the bag has a reinforcing strip of synthetic resin film extending along an upper edge above the draw sleeve. A wicket top is formed in the reinforcing strip for mounting the bag on the wicket pins of the bag packing machine or equipment.

BRIEF DESCRIPTION OF THE DRAWINGS

The objects, advantages and features of the invention will become more apparent by reference to the drawings appended thereto, wherein like numerals indicate like parts and wherein an illustrated embodiment of the invention is shown, of which.

DESCRIPTION OF THE PREFERRED EMBODIMENT

Figure 6:
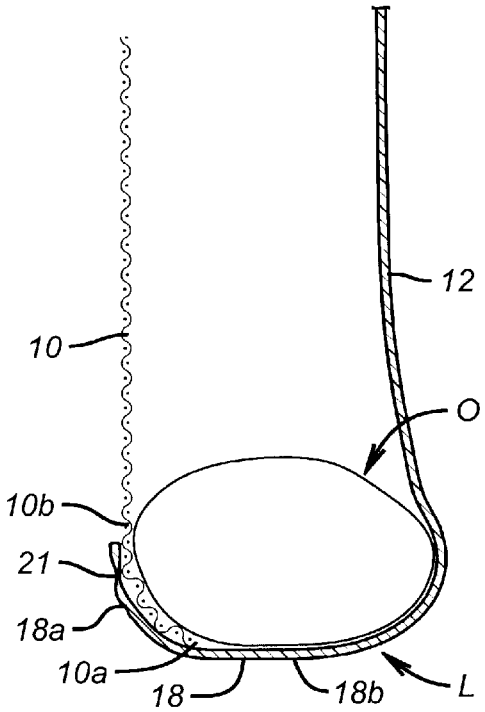
FIG. 6 is a cross-sectional view of a lower portion of the bag of FIG. 5 receiving an item or object of produce during filling.
Figure 9:
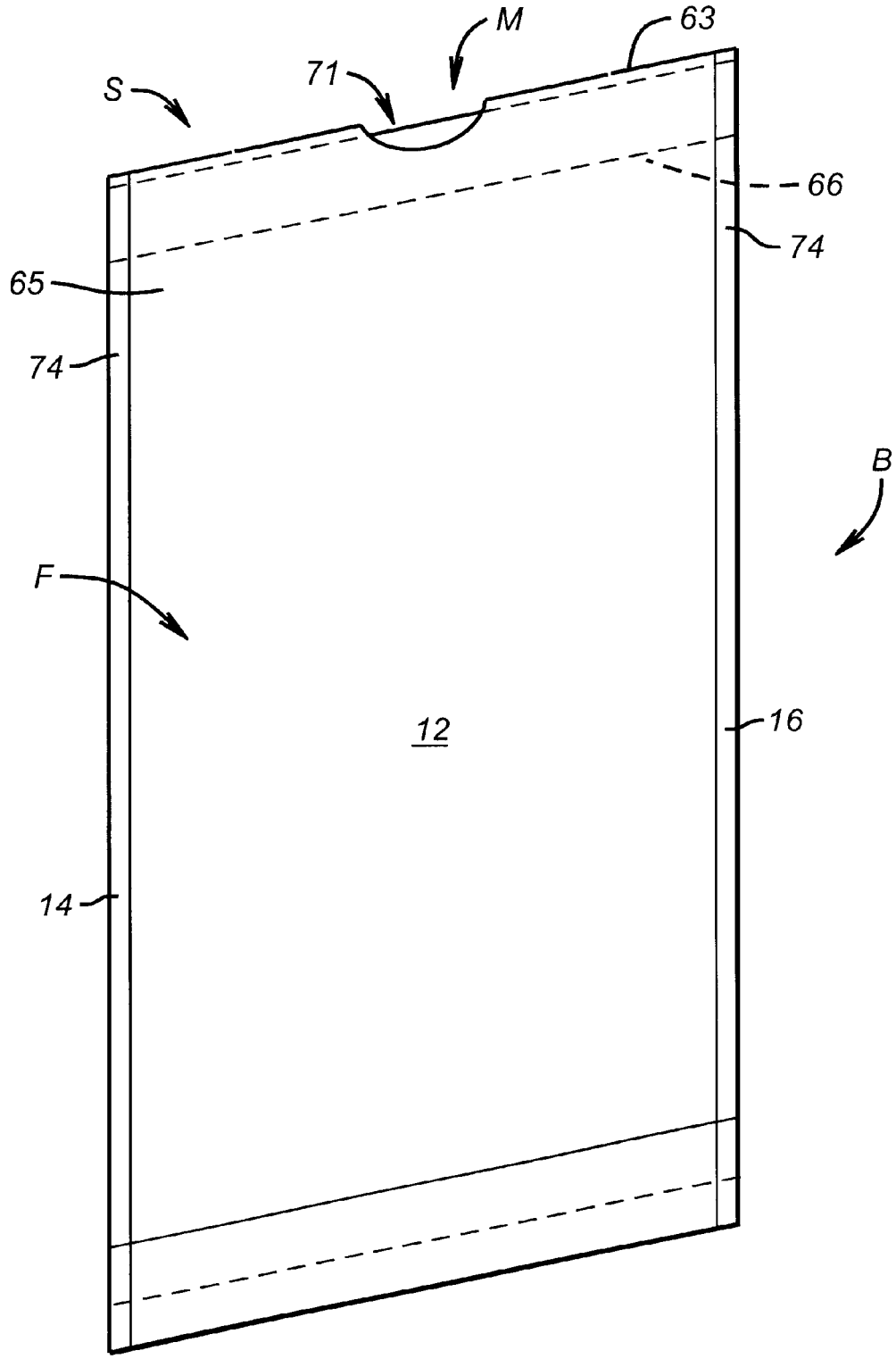
FIG. 9 is an isometric view of the bag of FIG. 1.

In the drawings, the letter B designates generally a synthetic resin bag according to the present invention. The bag B is a composite bag in that one of the side walls is formed of a synthetic resin mesh and the other is formed of a synthetic resin film. As will be set forth, the bag B may be used for produce and for a wide variety of other purposes and contents for which bags of mesh and film are used. The bag B may be used on wicket-pin machines and other types of bag loading machines, as will be noted. The bag B is provided with a draw top T having a first draw sleeve F and a second draw sleeve S. A draw member M is mounted in each of the draw sleeves F and S. The draw member M may be a band, strip, cord, string or the like. With the present invention, the draw members M provide users of the bag B with a built-in closure mechanism permitting the bag to be re-closed after some of its contents are removed. The draw members M also serve as a lifting or carrying grip for the bag B. The bag B may be filled by hand or by machine, as will be set forth below, The bags B may be made or formed by hand or machines. The bag B has a first, usually a rear side wall 10 (FIG. 6), which is formed of a suitable synthetic resin fiber mesh. One type of such a mesh is the cross-laminated airy fabric material, or CLAF®, available from Atlanta Nisseki CLAF, Inc. This type of fiber mesh or fabric is an open mesh material of cross-laminated warp and weft strands or fibers of a suitable synthetic resin.

A second, usually a front, side wall 12 of the bag B in the preferred embodiment is a suitable synthetic resin film, such as polyethylene or polypropylene, numerous types of which are commercially available. Example films are 1.50, 1.65 and 2.25 mil MDPE with an EVA additive. Air or breather holes may be formed in film 12, if desired.

The bag B in certain embodiments of the present invention is specifically adapted for use with wicket pins of commercially available automatic produce bag filling equipment. The bag B may also be used with carousel loading machines as well. The following chart is a list of examples of bag filling equipment for which bags according to the present invention may be used:

| SOURCE | MODEL |
|---|---|
| Ag-Pak, Inc. | Double Ag-Pak Weigh/Bagger |
| Ag-Pak, Inc. | Octopak Rotary Bagger |
| Ag-Pak, Inc. | Mega Pak Bagger |
| Yakima Wire Works | MBU/9300 Automatic Poly Bagger |
| Spang & Brands | Automatic Weigher/Bagger |
| Automatic Bagging Systems, Inc. | Vindicator Bagger |
| Lockwood Packing Corp. | Carousel Bagger |
| Volm Bag Co. | VP10 & VP12 with carousel bagger |

With the present invention, when used with wicket pins the mesh side wall 10 is preferably a rear wall of the bag B and the film side wall 12 is a front or forward wall. The bag B is placed in groups or sets on wicket pins of automatic filling equipment to receive and be filled with produce. As will be set forth below, the resin film wall 12 faces outwardly or to the front, ahead of the rear mesh wall 10, when properly installed.

The particular horizontal and vertical dimensions of the side walls 10 and 12, as well as their thickness, are determined based on the expected weight and size of produce to be packed into the bag B by automatic produce packing machinery. The chart below gives example sizes for bags intended for various produce weights:

| PRODUCE WEIGHT | BAG WALL DIMENSIONS |
|---|---|
| 2 pounds | 10 inches by 16 inches |
| 3 pounds | 10.5 inches by 16 inches |
| 5 pounds | 10.5 inches by 19 inches |
| 10 pounds | 13 inches by 23 inches |

-continued

| PRODUCE WEIGHT | BAG WALL DIMENSIONS |
|---|---|
| 15 pounds | 15 inches by 24 inches |
| 20 pounds | 15 inches by 26.3 inches |

For bags of these sizes, the draw sleeves F and S, discussed in more detail below, are each typically two inches or so in height.

The bags B may be formed by hand or machines and preferably formed by machine. A suitable type of such machine has been manufactured by Ro-An Industries Corporation of Middle Village, N.Y.

The side walls 10 and 12 are bonded or sealed to each other along vertically extending side seams as indicated at 14 and 16. The seams 14 and 16 may be of any desired width, depending on holding strength desired for the bag B along its vertical sides. The joining of side walls 10 and 12 at the seams 14 and 16 may be done by any suitable bonding or sealing technique, such as heat, glue, sealant, or the like.

The first or rear side wall 10 extends downwardly only a certain length to a lower edge 10*a* (FIG. 5) which is slightly less than the entire length of a completed bag. For example, in a bag for five pounds of produce the mesh side wall extends only 18½ inches for a typical bag depth of twenty inches.

Figure 1:
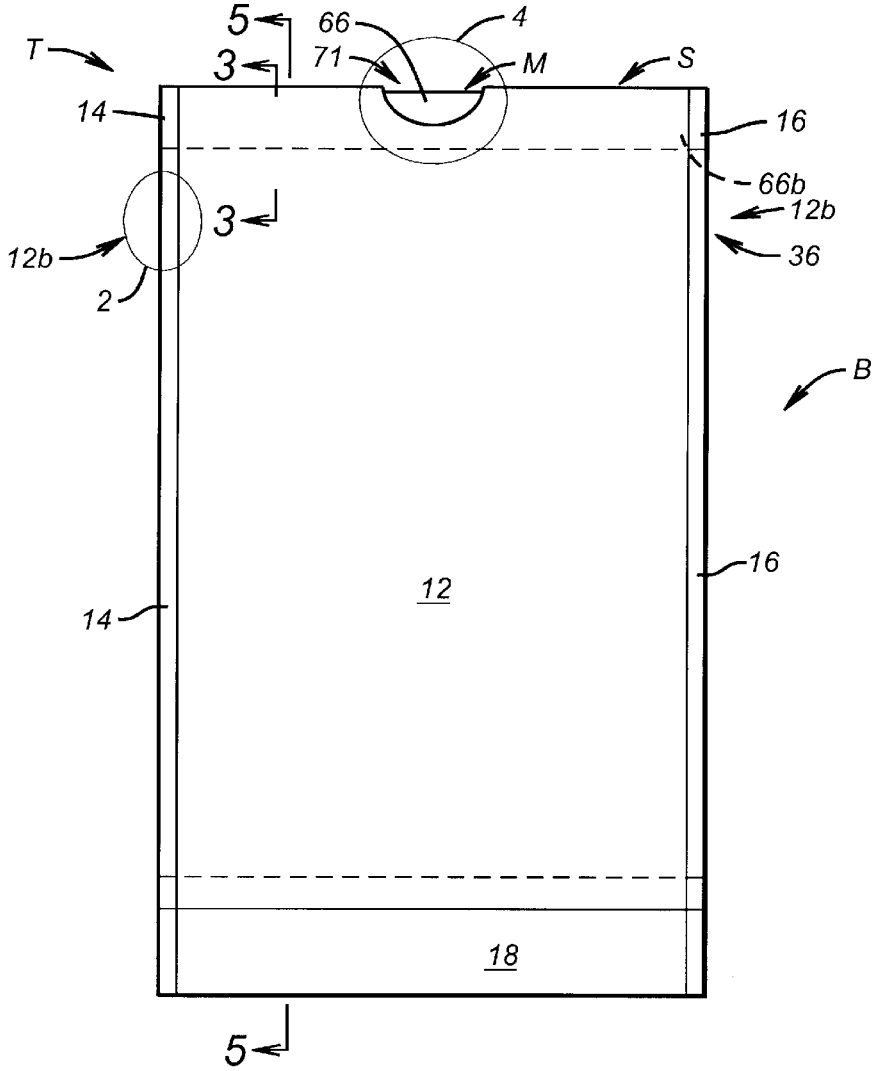
FIG. 1 is a front elevation view of a produce bag according to the present invention.
Figure 2:
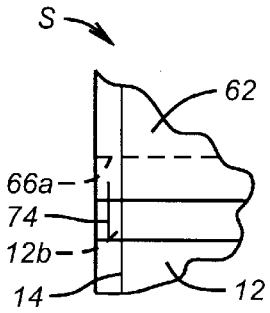
FIG. 2 is an enlarged view of a portion of the bag of FIG. 1 encircled and having reference numeral 2 indicating same.
Figure 3:
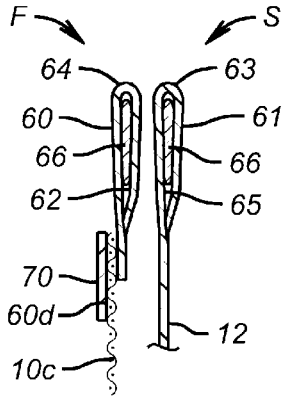
FIG. 3 is an enlarged, cross-sectional view taken along the lines 3—3 of FIG. 1.
Figure 4:
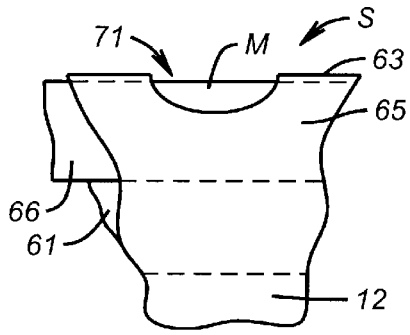
FIG. 4 is an enlarged view of a portion of the bag of FIG. 1 encircled and having reference numeral 4 indicating same.
Figure 5:
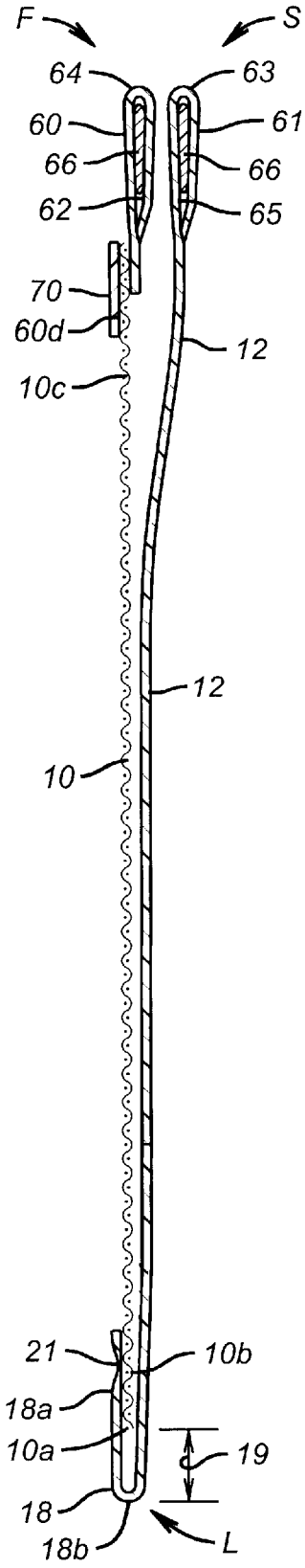
FIG. 5 is a cross-sectional view taken along the lines 5—5 of FIG. 1.
Figure 10:
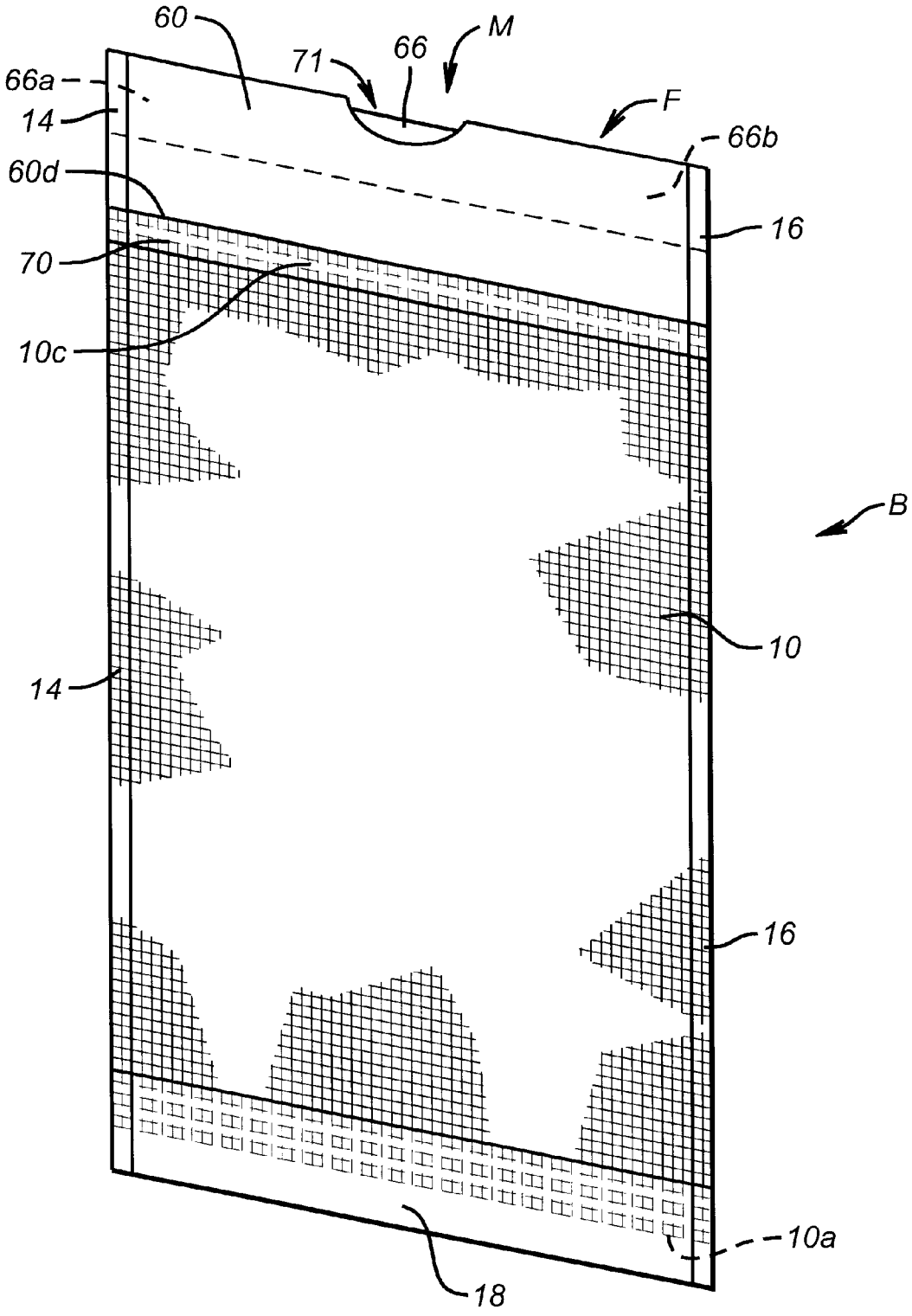
FIG. 10 is an isometric view of the bag of FIG. 1, taken from an opposite direction to that of FIG. 9.

The front or film bag wall 12 extends over a front face portion F over the entire length of the assembled bag B. The second or front side wall 12 also has a lower side wall extension portion 18 (FIGS. 1, 5 and 10) somewhat longer in vertical extent, for example three inches or so for a five pound produce bag than the first or rear mesh side wall 10. The extension 18 extends downwardly a first length of about one-half inch or so for a five pound bag, as indicated by an arrow 19 (FIG. 5). As the bag B is being assembled, the extension 18 is folded upwardly against an outer surface 10*b* of the rear mesh bag wall 10.

The portion 10*b* of the rear fiber mesh bag wall 10 above the edge 10*a* and an upper portion 18*a* of the extension 18 are joined together as indicated at 21. The joining may be by any suitable bonding or sealing technique of the type previously mentioned. The bag B when assembled thus has a lower fold L formed as a bottom portion 18*b* of the extension 18 of the front resin wall 12.

The fold L of resin exhibits and possesses no seam. Thus, when a produce object O or some other product falls into the bag B (FIG. 6), their weight and impact is received along a continuous, unitary strip of synthetic resin fiber, formed by the fold L. No seam is present between the side walls in the area of the fold L receiving the impact of entering articles. This continuous strip of material in the fold L exhibits greater strength during bag packing or loading. In addition, the seam or junction 21 is located upwardly away from the fold L at the bottom 18*b* of the bag. The seam or junction 21 is thus not directly subject to impact and weight of the produce or other product as it enters the bag B during packing.

In the bag B, each of the draw sleeves F and S are formed of a comparable synthetic resin film to that of the wall 12. The sleeve F has side walls 60 and 62 folded together at an upper central edge 64 extending downwardly from the edge 64. The side walls 60 and 62 extend laterally across top portions 10*c* of the bag wall 10 and are joined together as indicated at 60*a*. The joining may be performed by any suitable bonding or sealing technique, such as heat, glue, sealant or the like.

The draw sleeve S is formed by folding an extension 61 of the front resin wall 12 downwardly from a fold 63. The fold 63 is located at an upper end 65 of the front resin wall 12. The folded extension 61 and upper end 65 form the sleeve S for the draw member M.

The draw member M in the draw sleeves F and S, as has been set forth, can be any suitable cord, band, strip, cord or the like. As shown in FIGS. 1–4 and 7–10, the draw member M may be formed of a laterally extending band or strip 66 of comparable synthetic resin of suitable load-bearing strength to that of the sleeves F and S and the wall 12. End portions 66*a* and 66*b* of the draw band 66 are bonded or sealed within the sleeve at opposite side ends of the side walls 60 and 62. The draw band 66 in the sleeve S is similarly bonded or sealed at opposite side ends of the side walls 61 and 65. The side walls 60, 62 and 61, 65, respectively, and the draw bands 66 therein are joined together at sealing strips or seams at their adjacent side ends. The sealing strips or seams may be upward extensions of the side seams 14 and 16, or they may be separately formed, if desired. Again, the joining may be by any suitable bonding or sealing technique as has been described above.

Figure 7:
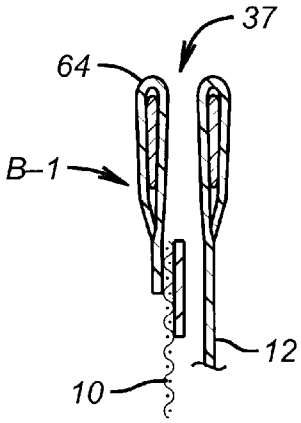
FIG. 7 is a cross-sectional view of alternative bag top to that of FIG. 5.
Figure 8:
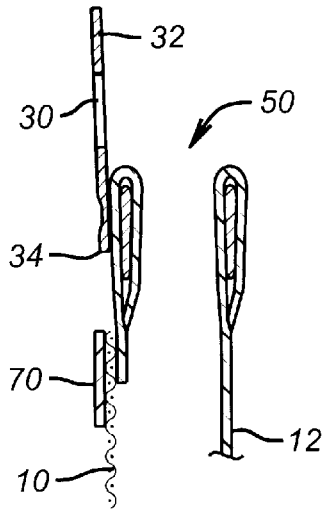
FIG. 8 is a view of an upper portion of the bag of FIG. 10 partially open to be packed with produce.

The first draw sleeve F is attached along the surface 60*d* across its lateral extent to a top portion 10*c* of the synthetic resin mesh side wall 10. If desired, an optional laterally extending mounting strip 70 of a suitable synthetic resin film may be included. Attachment along surface 60*d* may be any suitable bonding or sealing technique. When mounting strip 70 is included, the film of surface 60*d* and the mounting strip 70 enclose the fiber mesh wall top portion 10*c* between them. The mounting strip 70 may be mounted on the outside portion of the top 10*c* of bag wall 10, with the first draw sleeve being on the inner portion as shown in FIG. 5, or the relative positions of the mounting strip 70 and first mounting sleeve F reversed as in a bag B-1, as is shown in FIG. 7.

Figure 13:
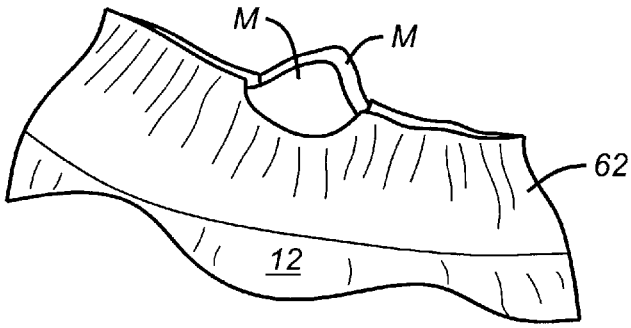
FIG. 13 is an isometric view of a top portion of the bag of FIG. 1 with the draw member pulled.

Each of the draw sleeves F and S is provided with an access opening or slot 71 for access to the draw member M mounted therein. The draw members M may be grasped and pulled (FIG. 13) to close the bag B at its top. Thereafter, the draw members M can be loosened for re-opening of the bag B when desired and the bag B closed again by tightening the draw members M.

A top corner area portion 12*b* (FIGS. 2 and 3) at each side of the edge 12*a* of the front film wall 12 may be bonded or sealed along with a corresponding area 10*c* of the mesh wall 10 to a corresponding area 72 at side ends of the side walls 60, 62 and 61, 65 respectively. This bonding occurs at each side of the lower portion 32*a* of reinforcing strip 32. The areas or portions 72, 10*b* and 12*b* are in overlapping areal extent with each other and have upper top corner portions 10*c* of the rear mesh side wall located therebetween. The three overlapping portions 12*b*, 10*b*, and 72 are bonded or otherwise sealed together (FIG. 2) to former top corner wall seal junctures 74. In those areas of this overlapping seal portion where fiber strands of the open mesh of the mesh portion 10*c* are not present, the overlapping resin film wall portions 12*b* and 72 fuse directly together, enclosing the fiber strands between them. This provides increased strength and holding power for the bag B at upper or top corner portions.

Figure 11:
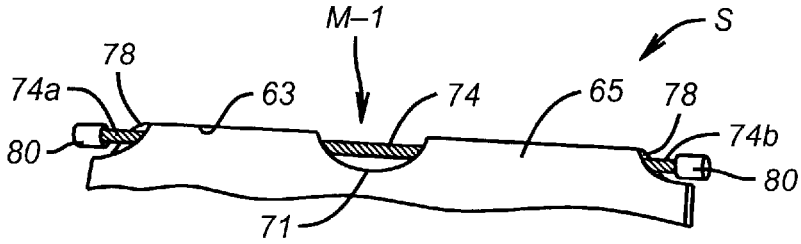
FIG. 11 is a front elevation view of an alternative bag draw top to that of FIG. 1.

The bag B may be provided with draw members of other types as well. As shown in FIG. 11, an alternative draw member M-1 in each of the draw sleeves F and S is formed of a cord or rope 74 of twine or other suitable material, such as cotton or synthetic resin.

In FIG. 11, each of the draw sleeves F and S include end openings 76 and 78 formed in them so that end portions 74*a* and 74*b* of the draw cord 74 may be joined together by a clip 80 or fastener of metal or other suitable material.

The bag of the present invention may also provided as shown in bag B-2 (FIG. 13) with a suitable number, usually at least two, of laterally aligned wicket holes 30 in a reinforcing strip 32 for suspension in an automatic produce packing machine so that the bag B may be filled with produce or product in a machine of that type. Other than the structure shown in FIG. 13, the remainder of the bag B-2 may be constructed like that of the bags B or B-1. The size of the wicket holes 30 is based upon the produce packing machine with which the bags B are to be used. A typical size of wicket hole 30 is one-half inch or so, for example.

According to the present invention, the reinforcing strip 32 is formed of a suitable synthetic resin film, for example like that of the front bag wall 12. The reinforcing strip 32 is bonded or sealed, as indicated at 34, across a laterally extending seam to the side wall 60 of the draw sleeve F mounted with the first side wall 10. Joining of the strip 32 to the side wall 10 at the seam 34 may be done in accordance with the bonding or sealing techniques previously described. The synthetic resin film of the reinforcing strip 32 may, as noted, be of the same, or alternatively a similar, synthetic resin material as the second side wall 12. The thickness and strength of the resin material of the strip 32 is selected according to the size of the bag B, as well as the weight of the produce to be packed into it.

The reinforcing strip 32 may be mounted on the side wall 60 of the draw sleeve F, as shown, or on the side wall 62. If mounted on the side wall 62, the reinforcing strip may extend downwardly below an upper lip or edge of the front side wall when mounted to the rear mesh wall 10. This structure is shown in Applicants' prior co-pending U.S. patent application Ser. No. 09/349,312 referenced above, which is incorporated herein by reference.

Figure 12:
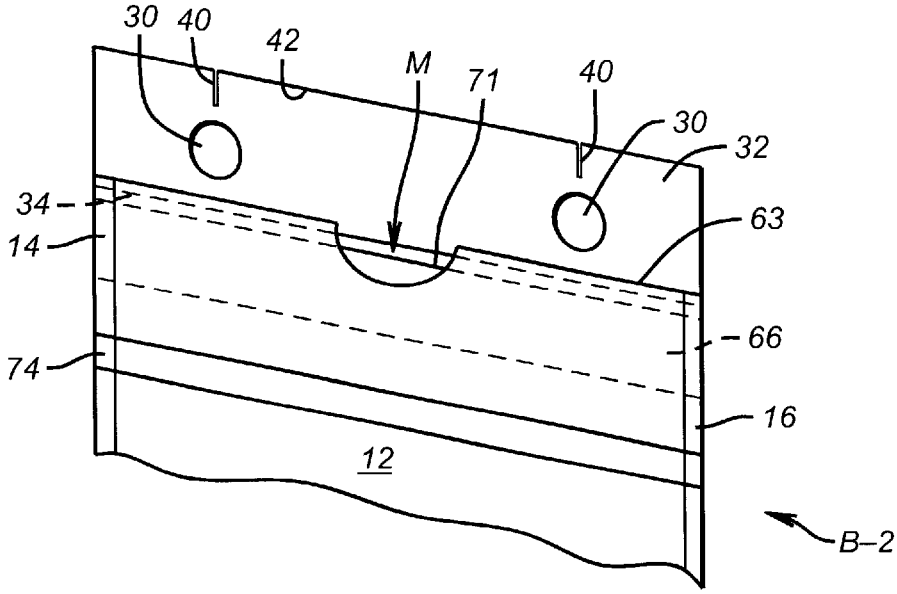
FIG. 12 is an isometric view of a produce bag with a wicket top according to the present invention.

The wicket reinforcing strip 32 of bag B-2 may also be provided with leaders, or cuts, 40 (FIG. 12) extending inwardly downwardly from an upper edge 42 opposite the seam 34 in the strip 32. The leaders 40 assist in removal of the bag B from the wicket pins in the packing machine once the bag B is filled.

Another advantage of the bag B-2 of the present invention is the location of the mesh side wall 10. The mesh side wall 10 is, as noted previously, is a rear bag wall when the bags are installed on wicket pins of the packing equipment. The front film side wall 12 thus faces forwardly on the produce packing machine to receive produce through the gap 37 (FIG. 8) at the top of the bag B-2 below reinforcing strip 32.

In a number of packing machines, the bag walls are partially separated as indicated at 50 (FIG. 8) either by blown air or suction to enlarge the top gap 37 for filling purposes. With the film side wall 12 on the front or forward face on the machine, the separating suction forces or bursts of air act on the enlarged surface area of the forward film side wall 12 rather than on the rear mesh wall portion 10. This opens the bags and greatly facilitates use of the bag B-2 in packing machines due to the top gap 37 being enlarged for receipt of produce during packing.

From the foregoing, it can be seen that composite bags of the present invention may also be provided to exhibit greater reliability during packing in automatic produce packing machines. The bags offer increased strength in holding produce and are more easily opened for filling. When used with wicket machines, the bags exhibit better capability of staying on the wickets of the machines as produce is being packed. The bags of the present invention are also less likely to suffer from bag material tearing or failure during loading.

Having described the invention above, various modifications of the techniques, procedures, material, and equipment will be apparent to those in the art. It is intended that all such variations within the scope and spirit of the appended claims be embraced thereby.

What is claimed is:

1. A synthetic resin bag, comprising:

first and second side walls joined along two side edges to form the bag;

one of the side walls being formed from a synthetic resin mesh;

one of the side wails being formed of a synthetic resin film;

a first draw sleeve extending laterally along an upper portion of the first side wall of the bag;

a second draw sleeve extending laterally along an upper portion of the second side wall of the bag;

a draw member mounted in each of the first and second draw sleeves;

each of the first and second draw sleeves having a slot formed therein for access to the draw member therein;

a mounting strip extending laterally across a top portion of the synthetic resin mesh side wall and attaching the synthetic resin mesh side wail to the draw sleeve associated therewith;

the synthetic resin film side wall having a bottom wall portion extending downwardly below the synthetic resin fiber mesh side wall and having a lower fold formed therein to form a bottom of the bag receiving the weight and impact of articles entering the bag; and the synthetic resin film side wall having an extension from the lower fold which is folded upwardly to enclose a lower portion of the synthetic resin fiber mesh side wall.

2. The bag of claim 1, wherein the draw members are draw bands.

3. The bag of claim 2, wherein the draw bands are formed of a synthetic resin film.

4. The bag of claim 3, further including:

a sealing strip formed along a side edge portion of each of the first and second side wails and their respective draw sleeves.

5. The bag of claim 4, wherein the sealing strips join the draw bands at end portions thereof to their respective draw sleeves.

6. The bag of claim 1, wherein the draw members are draw cords.

7. The bag of claim 6, wherein the draw cords are joined at end portions of each other.

8. The bag of claim 1, further including:

a sealing juncture formed between the first and second side walls along a side edge portion of the first and second side walls.

9. The bag of claim 1, wherein the synthetic resin mesh is a synthetic resin fiber mesh.

10. The bag of claim 1, wherein the synthetic resin film side wall extension is mounted with the synthetic resin mesh side wall.

11. The bag of claim 1, wherein the synthetic resin film side wall extension is mounted along a top of the upwardly folded extension with the synthetic resin mesh side wall.

12. The bag of claim 1, wherein the synthetic resin film side wall extension is mounted with the synthetic resin mesh side wall by a seam formed between them.

13. The bag of claim 1, wherein the synthetic resin film side wall extension is mounted along a top of the upwardly folded extension with the synthetic resin mesh side wall by a seam formed between them.

14. The bag of claim 1, further including:

a reinforcing strip of synthetic resin film extending upwardly along an upper portion of a draw sleeve of the bag.

15. The bag of claim 14, further including:

the reinforcing strip having holes formed therein for mounting the bag on the wicket pins of the bag filling equipment.

16. The bag of claim 15, further including said reinforcing strip having slits cut therein at a location spaced from the holes to allow for removal of the bag from the filling equipment.

17. The structure of claim 14, wherein the reinforcing strip is mounted with one of the draw sleeves along a seam formed therebetween.

18. The bag of claim 1, wherein a top corner portion of the synthetic resin mesh side wall at each side thereof is joined to the film side wall.

* * * * *

UNITED STATES PATENT AND TRADEMARK OFFICE

CERTIFICATE OF CORRECTION

PATENT NO. : 6,626,570 B2
DATED : September 30, 2003
INVENTOR(S) : L. Keith Fox and Kenneth S. Fox It is certified that error appears in the above-identified patent and that said Letters Patent is hereby corrected as shown below:

Title page,
Item [63], Related U.S. Application Data, delete "[63] Continuation-in-part of application No. 09/694,359, filed on Oct. 23, 2000, now Pat. No. 6,416,220, and a continuation-in-part of application No. 09/349,312, filed on Jul. 8, 1999, now Pat. No. 6,190,044, and a continuation-in-part of application No. 09/174,435, filed on Dec. 16, 1998, now Pat. No. 6,030,120, which is a continuation-in-part of application No. 09/212,169, filed on Oct. 16, 1998, now Pat No. 6,024,489."
and insert -- [63] Continuation-in-part of application No. 09/694,359, filed on Oct. 23, 2000, now Pat. No. 6,416,220, and a continuation-in-part of application No. 09/349,312, filed on Jul. 8, 1999, now Pat. No. 6,190,044, and a continuation-in-part of application No. 09/212,169, filed on Dec. 16, 1998, now Pat No. 6,024,489, which is a continuation-in-part of application No. 09/174,435, filed on Oct. 16, 1998, now Pat. No. 6,030,120. -- therefor.

Signed and Sealed this

Twenty-ninth Day of June, 2004

JON W. DUDAS
*Acting Director of the United States Patent and Trademark Office*